United States Patent [19]

Hanselmann et al.

[11] Patent Number: 4,984,336

[45] Date of Patent: Jan. 15, 1991

[54] ADJUSTABLE GRID FOR THE EXTRACTION ARM OF A BALE-OPENER MACHINE

[75] Inventors: Daniel Hanselmann; Walter Schlepfer; Jost Aebli, all of Winterthur, Switzerland

[73] Assignee: Rieter Machine Works Ltd., Winterthur, Switzerland

[21] Appl. No.: 390,248

[22] Filed: Aug. 7, 1989

[30] Foreign Application Priority Data

Aug. 12, 1988 [DE] Fed. Rep. of Germany ..... 3827517

[51] Int. Cl.[5] ..... D01G 7/12

[52] U.S. Cl. ..... 19/80 R

[58] Field of Search ..... 19/80 R, 81, 83, 85, 19/86

[56] References Cited

U.S. PATENT DOCUMENTS

| | | | |
|---|---|---|---|
| 3,381,341 | 5/1968 | Platt et al. | 19/80 R |
| 4,281,437 | 9/1981 | Marx | 19/80 R |
| 4,297,767 | 11/1981 | Leifeld | 19/80 R |
| 4,477,944 | 10/1984 | Binder et al. | 19/80 R |
| 4,510,646 | 4/1985 | Locatelli et al. | 19/80 R |
| 4,513,479 | 4/1985 | Binder et al. | 19/80 R |
| 4,586,217 | 5/1986 | Kranefeld et al. | 19/80 R |
| 4,623,099 | 11/1986 | Vosbein et al. | 19/80 R |
| 4,707,888 | 11/1987 | Binder et al. | 19/80 R |
| 4,748,725 | 6/1988 | Temburg et al. | 19/80 R |
| 4,750,240 | 6/1988 | Temburg | 19/80 |
| 4,756,059 | 7/1988 | Temburg | 19/80 R |
| 4,796,335 | 1/1989 | Kranefeld | 19/80 R |

FOREIGN PATENT DOCUMENTS

| | | |
|---|---|---|
| 0199041 | 10/1986 | European Pat. Off. . |
| 3121030 | 12/1982 | Fed. Rep. of Germany . |
| 3544435 | 6/1987 | Fed. Rep. of Germany . |
| 8627019.2 | 3/1988 | Fed. Rep. of Germany . |
| 2506793 | 12/1982 | France . |
| 2591617 | 6/1987 | France . |
| 2100766 | 1/1983 | United Kingdom . |

*Primary Examiner*—Werner H. Schroeder
*Assistant Examiner*—John J. Calvert
*Attorney, Agent, or Firm*—Sandler, Greenblum & Bernstein

[57] ABSTRACT

An adjustable grid for the extraction arm of a bale-opener machine for adjusting the depth of penetration of drivable fiber extraction elements extending between the grid bars which are substantially tranversely arranged relative to the longitudinal direction of the extraction arm, has the grid bars biased by the spring devices into an abutment position corresponding to a minimum depth of penetration of the extraction elements. The spring force is selected such that the moveably arranged grid bars are displaced, in accordance with the bale hardness, in the direction of increasing depth of penetration of the extraction elements into a position which at least approximately corresponds to the appropriate depth of penetration of the extraction elements.

48 Claims, 4 Drawing Sheets

ADJUSTABLE GRID FOR THE EXTRACTION ARM OF A BALE-OPENER MACHINE

BACKGROUND OF THE INVENTION

The present invention broadly relates to a bale-opener machine and, more specifically, pertains to a new and improved construction of adjustable grid for the extraction arm of a bale-opener machine for adjusting the depth of penetration or projection of drivable fiber flock extraction elements extending between the grid bars which are substantially transversely arranged relative to the longitudinal direction or direction of extent of the extraction arm.

An adjustable grid of this type is known, for example, from European Published Patent Application No. 86103135, published Oct. 20, 1986 under Publication No. 0,199,041, and U.S. Pat. No. 3,381,341, granted May 7, 1968.

It is hitherto customary to open bales, for instance fiber bales, by means of a bale-opener machine, the bales being arranged in a row one behind the other and substantially parallel to the direction of motion of the bale-opener machine. It is known by experience that some bales are harder or softer than the average bale and that even the bale compression varies as a function of the extent to which the bale is opened. Due to such differences in bale compression, it is necessary to vary the depth of penetration or projection of the fiber flock extraction elements of the bale-opener machine. The depth of penetration or projection of the fiber flock extraction elements is defined as the distance by which the fiber flock extraction elements project underneath or below the grid which slides over the surface of the bales. The depth of penetration differs from the feed depth which is a dimension for the vertical or elevational adjustment of the entire extraction arm of the bale-opener machine when the latter again moves along the row or bales.

The hitherto proposed mechanisms for setting the depth of penetration or projection of the fiber flock extraction elements by adjusting the grid are relatively complicated. For example, in the aforementioned U.S. Pat. No 3,381,341, the therein disclosed textile finer bale-opener unit requires a number of bevel gears to adjust the grid and such gears alone represent a relatively high constructional expenditure. In order to adjust the grid at both ends, either an additional complicated gear system or two separate drive motors for the corresponding gear wheels arranged at both ends of the grid are required, in which latter case it would then be necessary to provide a synchronization of the two motors. In the known or prior art arrangement it is also not possible to adjust the inclination of the grid.

The apparatus for extracting fiber flocks or tufts from textile fiber bales disclosed in the aforesaid European Published Patent Application No. 86103135 (publication No. 0,199,041) enables the depth of penetration or projection as well as the inclination of the grid to be adjusted, but also requires four drive motors which have to be synchronized at least in pairs.

SUMMARY OF THE INVENTION

Therefore, with the foregoing in mind, it is a primary object of the present invention to provide a new and improved construction of adjustable grid for the extraction arm of a bale-opener machine and which adjustable grid does not suffer from the aforementioned drawbacks and shortcomings of the prior art constructions.

Another and more specific object of the present invention aims at providing a new and improved construction of adjustable grid for the extraction arm of a bale-opener machine, and which adjustable grid is of relatively simple construction and design as well as quite economical to manufacture and yet affords highly reliable operation for automatically adapting the depth of penetration or projection of the fiber flock extraction elements to the bale hardness and, if required; also in the event of varying hardness in the transverse direction relative to a row of bales.

Yet a further significant object or the present invention aims at providing a new and improved construction of adjustable grid for the extraction arm of a bale-opener machine, which adjustable grid renders possible that the adaptation of the depth of penetration or projection of the fiber flock extraction elements to the bale hardness can be achieved without the use or any form of actuating motor.

Now in order to implement these and still further objects or the present invention, which will become more readily apparent as the description proceeds, the adjustable grid of the present invention is manifested, among other things, by the features that the grid bars are movably arranged at both ends thereof and are biased by spring devices or mechanisms into an abutment position corresponding to the minimum depth of penetration or projection of the fiber flock extraction elements and the spring force is selected such that the movably arranged grid bars are displaced, in accordance with the bale hardness, in the direction of increasing depth of penetration or projection of the fiber flock extraction elements into a position which at least approximately corresponds to the appropriate depth of penetration or projection of the fiber flock extraction elements.

The present invention is based on the findings that the depth of penetration or projection of the fiber flock extraction elements must be reduced for softer bales and increased for harder bales. The reason is that in the case of softer bales the drivable fiber extraction elements tend to tear more flocks or tufts out of the bales than when the bales are harder. To counteract this tendency in the case of softer bales, the depth of penetration or projection is reduced for further softer bales. In practice the range of adjustment of the depth of penetration or projection is about 7 mm.

The present invention is also based on the fact that the upward force exerted on the grid bars is greater in the case of harder bales.

Furthermore, the present invention is also founded upon the realization that by downwardly spring-loading the grid bars it is possible to use the greater upward force exerted by harder bales to increase the depth of penetration or projection of the fiber flock extraction elements. In other words, if the spring properties or characteristics are suitable designed, automatic adaptation of the depth of penetration or projection to the bale hardness is rendered possible.

The adjustable grid constructed according to the invention requires only relatively simple and reliable mechanical components or parts in order to obtain qualitatively high-grace adaptation to the bale hardness. Motors and complicated gears are unnecessary and can be dispensed with, thus avoiding high constructional expenditure for synchronization systems.

It can be possibly desirable to alter only the corresponding abutment position for the purpose of setting the maximum or minimum depth of penetration or projection of the fiber flock extraction elements. Therefore, the adjustable grid constructed according to the invention provides means to preset the predetermined abutment position, either manually or mechanically.

In the simplest case it is sufficient to work with adjusting screws which can be set by the operational staff, but it stands to reason that the adjusting screws can be set by a small electric motor or, if required, by an automatic open or closed loop control system. However, in this case it is only a matter of setting the minimum or maximum depth of penetration or projection of the fiber flock extraction elements and not of adapting the depth of penetration or projection to varying bale hardness present during operation.

A particularly preferred exemplary embodiment of the present invention is characterized in that the individual grid bars can be biased by respective spring devices or mechanisms into the predetermined abutment position. In this manner, each moveably arranged grid bar automatically adapts itself to the local bale hardness in that the local depth of penetration or projection of the fiber flock extraction elements is altered. This is particularly advantageous in the case of a relatively long extraction arm, i.e. in a bale-opener machine for which several bales are disposed side by side in the substantially transverse direction of the bale-opener machine.

In another exemplary embodiment of the adjustable grid the grid bars are adjustable in groups. Each group of grid bars could extend, for example, across the width of a bale. Alternatively, all grid bars of the extraction arm can be rigidly interconnected and form an entire or complete grid or grid structure, in which case the depth of projection of the fiber flock extraction elements can be automatically adjusted by pressing the grid as a whole out of the abutment position against the action of the spring device or mechanism. The two variants, namely the grid bars being adjustable in groups and all grid bars forming an entire or complete adjustable grid or grid structure, have the advantage that relatively few spring devices or mechanisms or springs are required. After all, it is quite sufficient when each group or each grid is spring-loaded by at least two spring devices or mechanisms arranged at one lengthwise side of the extraction arm.

A particularly preferred exemplary embodiment of an adjustable grid, in which the individual grid bars are adjustable, is characterized in that each grid bar at least at one end thereof comprises an elongated hole which extends at least substantially perpendicular to the lengthwise direction of the grid bar. A guide rod secured at the extraction arm extends through the elongated hole. A compression spring is arranged between the aforesaid one end of the grid bar and the extraction arm. If necessary, the guide rod is adjustable in position.

This arrangement is particularly simple. Each grid bar requires only one compression spring, which directly acts at one end of the grid bar, and a suitable abutment for this compression spring. The other end of the grid bar can be either pivotably attached to the extraction arm or likewise spring-loaded by means of a simple compression spring. In this arrangement the lateral guidance of the grid bars, i.e. in the transverse direction, is achieved by the guide rod extending through the aforementioned elongated hole, such guide rod serving a double purpose in that it determines the predetermined abutment position of the grid bars by contact with one end of the elongated hole.

This arrangement is also particularly advantageous because it renders possible a very compact construction. The compression springs can be readily arranged on the left and right side of the working or operating circle of the associated drivable fiber flock extraction elements at the lower end of such working or operating circle, so that the extraction arm itself can have relatively small overall dimensions. More particularly, the relatively small compression springs do not interfere with the extraction or removal or the fiber flocks taken from the bales.

Another exemplary embodiment, in which each grid bar is individually spring-loaded, is characterized in that at least one end of each grid bar engages one end of a lever pivotably arranged at the extraction arm, such lever serving to downwardly press the grid bar into the abutment position. Suitable springs act upon respective levers. This embodiment is also relatively simple in construction and design and therefore economical to manufacture.

An exemplary embodiment comprising levers constructed as double-armed levers and springs acting at respective ends of such double-armed levers, which ends are remote from the grid bars, is particularly advantageous in that the springs can be arranged at a distance from the grid bars, so that very few components in the region of the grid bars are required for biasing the latter into the predetermined abutment position. Consequently, cotton flocks taken from the bales by the drivable fiber flock extraction elements can be removed without obstruction.

There is also no difficulty in mechanically attaching the abutments for defining the predetermined abutment position of the grid bars, since the abutments can cooperate with the lever arms.

In a further exemplary embodiment of the adjustable grid, each double-armed lever has a cylindrical end portion which engages with and is slideably guided in a lateral recess or opening at one end of the associated grid bar. The cylindrical end portion of each double-armed lever serves to prevent lateral tilting of the associated grid bar. Therefore, the double-armed levers serve a double purpose, namely, on the one hand, to adjust the grid bars and, on the other hand, to render possible the guidance of the grid bars. However, this guidance not only serves to prevent lateral tilting of the grid bars but also to guide the grid bars by the lever ends in the transverse direction of the extraction arm.

There is no risk of displacement of the grid bars in the longitudinal direction of the extraction arm it each grid bar, in top plan view, possesses an I-shaped form or shape and adjacent grid bars contact one another at the end faces of the top and bottom webs or legs of the respective I-shaped profiles.

All double-armed levers or groups of double-armed levers at each lengthwise side of the extraction arm can be arranged at common pivot shafts and have lateral contact with one another in the region of the respective common pivot shaft. This renders possible a space-saving accommodation of the pivot shafts for the double-armed levers, thus avoiding the need for special spacers.

A further preferred exemplary embodiment, in which the grid bars are adjustable in groups or in the form of an entire or complete grid, is characterized in that a guide rod extends through each group of grid bars or the entire or complete grid at the two lengthwise sides thereof which are substantially parallel to the extraction arm, the guide rods being guided at both ends in guides at the end faces of the extraction arm and, if required, at intermediate locations in intermediate guides of the extraction arm. Each group of grid bars or the entire or complete grid comprise at least two spring devices or mechanisms at at least one lengthwise side thereof, and at least the guides or intermediate guides of the extraction arm provided at such at least one lengthwise side are constructed as substantially perpendicularly extending elongated holes for the associated guide rod. This embodiment only requires a small number of spring devices or mechanisms which can be also disposed outside the extraction arm, for example, at the end faces thereof. In this manner, the spring devices or mechanisms do not restrict the removal of fiber flocks or tufts or the like extracted from the bales.

Finally, in a particularly preferred exemplary embodiment of the adjustable grid each guide rod is guided in crossed elongated holes or guide slots, thus achieving perfect guidance of the grid bars.

The adjustable grid constructed according to the invention also renders possible that the bias of the spring devices or mechanisms can be set individually for each spring device or mechanism and/or jointly for all spring devices or mechanisms together, so that here also there is a vast variety of possibilities of obtaining in each case the optimum adaptation of the depth of penetration of the fiber flock extraction elements to the bale hardness. Finally, the spring devices or mechanisms are not necessarily tension or compression springs, but can also be, for example, rubber springs, hydraulic springs, gas pressure springs or the like.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Figure 1:
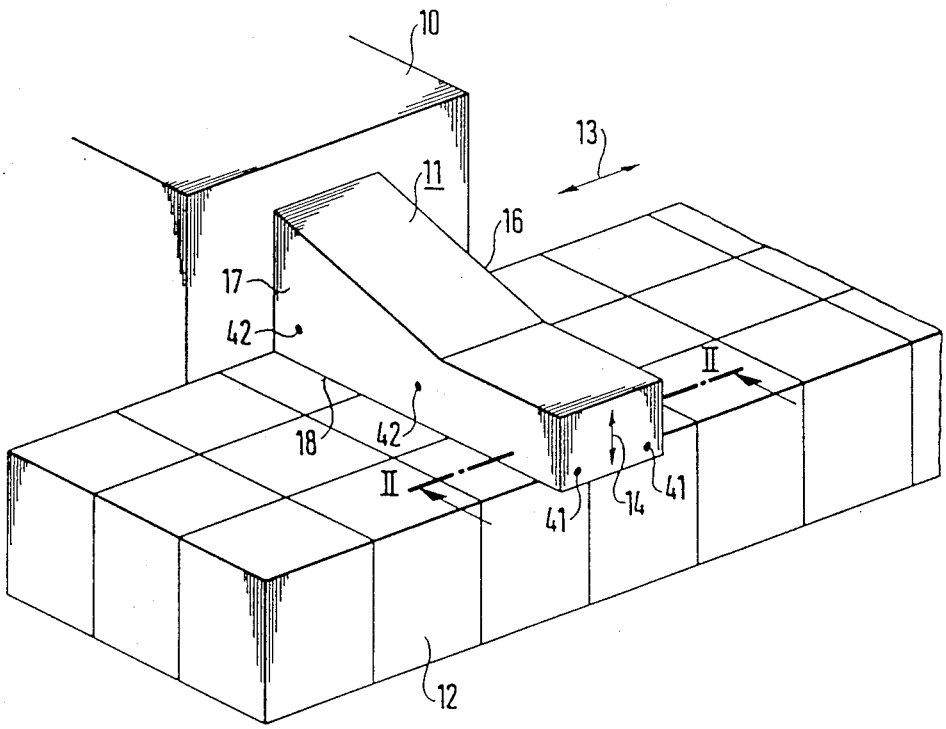
FIG. 1 is a perspective illustration or a part of a bale-opener machine.

Describing now the drawings, it is to be understood that to simplify the showing thereof, only enough of the extraction arm of the bale-opener machine has been illustrated therein as is needed to enable one skilled in the art to readily understand the underlying principles and concepts of this invention. Turning attention now specifically to FIG. 1, there has been illustrated in perspective view a very simplified representation of a part of a bale-opener machine comprising a tower 10 supporting an extraction arm or arm member 11 which is reciprocatingly moveable in the direction of the double-headed arrow 13 along a row of bales 12. The extraction arm 11 can be appropriately elevationally adjusted in the direction of the double-headed arrow 14, in order to set the feed depth of the extraction arm 11 for each new movement along the row of bales 12. The row of bales 12 has, for instance, a width of three bales, i.e. the extraction arm 11 extends across three bales and simultaneously extracts flocks from all three bales.

In known manner, an extraction roll or roller comprising fiber flock or fiber tuft extraction elements not particularly shown in the drawing of FIG. 1 is located within the extraction arm 11 and has working spikes or tooth-like projections which loosen or remove the fiber flocks or the like from the bales.

The internal components of the fiber flock or fiber tuft extraction means will be discussed hereinafter in conjunction with FIG. 2 which is a sectional side view of an adjustable grid bar constructed according to the invention, the section substantially being taken along the line II—II in FIG. 1.

Figure 2:
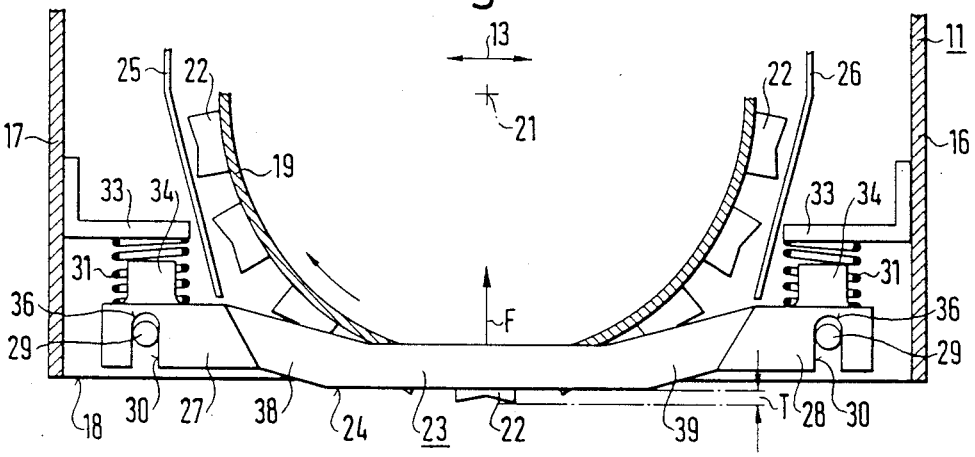
FIG. 2 is a sectional side view of an adjustable grid bar constructed according to the invention, the section being taken substantially along the line II—II in FIG. 1.

FIG. 2 shows the, for instance, front and rear lengthwise sides 16 and 17 as well as the lower or bottom edge 18 of the extraction arm 11. A rotatable extraction roll or roller 19 is provided within the extraction arm and is rotatably mounted for rotation about an axis of rotation 21. The rotatable extraction roll or roller 19 possesses at its outer surface individual tooth-like fiber flock or fiber tuft extraction elements 22. Such tooth-like extraction elements 22 are arranged at several working or operating circles disposed in tandem, each such circle being inclined at an angle to the axis of rotation 21, so that the individual tooth-like extraction elements 22 carry out a tumbling motion. Each circle of the tooth-like extraction elements 22 moves within the gap located between two adjacent grid bars 23, only one grid bar 23 being visible in FIG. 2. The lowest tooth-like extraction element 22' is elevationally lower by an extent or distance T than the bottom side or surface 24 of the grid bar 23. The extent or distance T represents the depth of penetration or projection.

Two guide plates 25 and 26 are arranged at the left and right side of the rotatable extraction roll or roller 19 and cooperate with the surface of the latter to form a guide passage or channel for removing the fiber flocks loosened from the row of bales 12.

In top plan view, individual grid bars or bar members 23 possess an I-shaped form and are guided at respective ends 27 and 28 by guide rods 29 arranged in downwardly open slot-like recesses or openings 30 provided at the ends 27 and 28 of the individual grid bars 23. In practice, it is likely that the grid bars 23 would assume an inclined or slanting position, and the slot-like recesses 30 are therefore structured, at least at one of the ends 27 and 28, somewhat wider than the diameter of the guide rods 29, so that such inclined or slanting position of the individual grid bars 23 cannot cause a jamming of the latter.

A helical compression spring 31 is provided above each of the ends 27 and 28 of the shown grid bar 23. Each helical compression spring 31 presses at one end against a related top side or surface 32 or the grid bar 23 and at the other end against a flange-like abutment 33 which is fixedly arranged at the walls of the lengthwise sides 16 and 17 of the extraction arm 11. The helical compression springs 3 are centered by respective pins 34, the length of the pins 34 being selected such that the helical compression springs 31 are held at both ends and thus cannot come loose.

When the extraction arm 11 is in the raised position, i.e. when it is not pressing against the row of bales 12, the helical compression springs 31 downwardly press the grid bar 23, so that the ends 36 of the slot-like recesses 30 are pressed against the guide rods 29 and thus determine the predetermined abutment position of the grid bar 23 and, accordingly, the minimum depth of penetration or projection of the fiber flock extraction elements 22.

During operation, the bottom side or surface 24 of the grid bar 23 is subjected to a force F which depends on the momentarily encountered hardness of the bale 12 located therebelow. The helical compression springs 31 are compressed to an extent depending on the magnitude of the force F., so that the depth of penetration or projection of the fiber flock extraction elements 22 varies in accordance with the magnitude of this force F.

Basically, a distribution of force is effected along the bottom side or surface 24 or the grid bar 23, and it is not at all certain that the resulting force acts in the middle of the grid bar 23 as indicated in FIG. 2. However, this is of no importance, since the helical compression springs 30 at the left and right side of the grid bar 23 depicted in FIG. 2 are compressed by different amounts, so that the position of the grid bar 23 automatically adjusts to the actually present distribution of force.

In this embodiment the upward movement of the grid bar 23 is determined or limited by the flat upper side or surface 75 of the pin 34, which flat upper side or surface 75 presses against the associated flange-like abutment 33. As shown in FIG. 2, the grid bar 23 comprises inclined surfaces 38 and 39 on the left and right side, respectively, such inclined surfaces 38 and 39 representing a sort of run-up slope or ramp, and thus exercising a skid-like effect, depending on the direction in which the extraction arm 11 is moving as indicated by the double-headed arrow 13.

If the bale-opener machine is designed such that the extraction arm 11 moves only in one direction, for instance in the case of a rotary tower construction, or extracts only in one direction, it is sufficient to bias the grid bars 23 into the predetermined abutment position by means of a helical compression spring 31 arranged only at one end of the grid bars 23. The other end can be simply pivoted, but allowance must be made for about twice the amplitude of motion of the spring-loaded end of the grid bar 23, in order to obtain the same range of adjustment of the depth of penetration or projection.

The guide rods 29 are fixedly mounted at the end faces of the extraction arm 11 as designated, for example, by reference character 41 in FIG. 1. Alternatively, the guide rods 29 can be supported at intermediate locations within the extraction arm 11 as designated, for example, by reference character 42 in FIG. 1.

Figure 3:
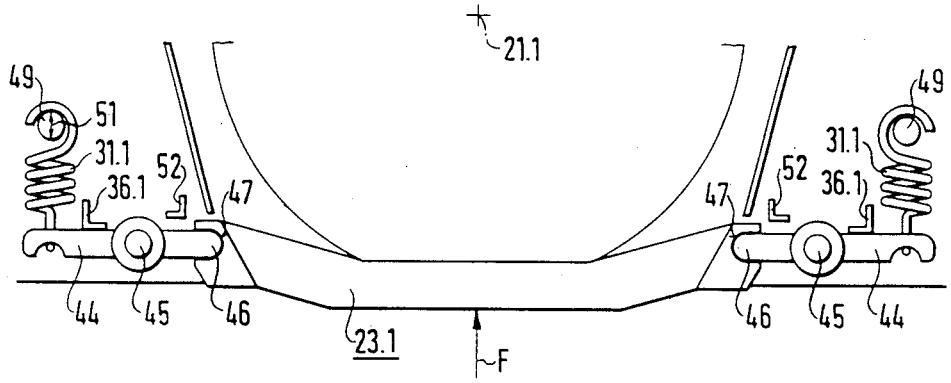
FIG. 3 shows a further exemplary embodiment of an adjustable grid bar depicted in side view similar to that of FIG. 2.
Figure 4:
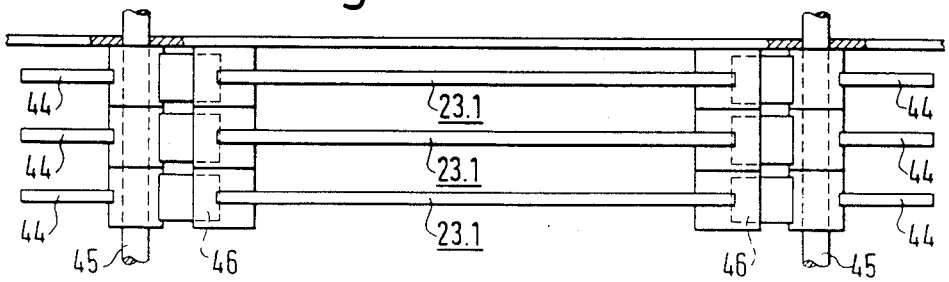
FIG. 4 is a top plan view to the grid bar depicted in FIG. 3 and shows further grid bars.

FIGS. 3 and 4 show a further exemplary embodiment of the adjustable grid constructed according to the invention. The same or analogous components or parts are generally denoted by the same reference characters used in FIG. 2, but they are distinguishable by the suffix 0.1. For reasons of simplicity the lengthwise sides 16 and 17 of the extraction ar 11 are omitted in FIGS. 3 and 4 and in the further FIGS. 5 through 8.

The embodiment shown in FIG. 3 contains a special feature in that the grid bars 23.1 are spring-loaded by means of double-armed levers 44 whereby, as also depicted in FIG. 4, each double-armed lever 44 is rotatedly mounted for pivoting about a stationary pivot or pivot shaft 45. The pivots or pivot shafts 45, of which there are two in this embodiment, are secured, similar to the guide rods 29 of the embodiment depicted in FIG. 2, at the end faces or at intermediate locations of the extraction arm 11. Each double-armed lever 44 comprises at its end facing the grid bar 23.1 a substantially cylindrical head or head portion 46, the cylinder axis of which extends substantially parallel to the axis of rotation 21.1 of the rotatable extraction roll or roller 19. The cylindrical head 46 fits into a correspondingly formed or shaped recess or opening 47 at the associated end of the grid bar 23.1. Although not specifically shown in FIG. 3, a certain clearance is also provided here to prevent the grid bars 23.1 from jamming when in an inclined or slanting position.

According to FIG. 3 of the drawings, the grid bars 23.1 are spring-loaded by tension springs 31.1 which respectively engage the double-armed lever 44 at the end remote from the cylindrical head 46 and upwardly pull the double-armed levers 44. The end of each tension spring 31.1 remote from the double-armed lever 44 is anchored at a rod 49 which, similar to the pivots or pivot shafts 45, is mounted at the end faces of the extraction arm 11 and, if required, likewise at intermediate locations along the lengthwise sides 16 and 17 of the extraction arm 11. As generally indicated by the double-headed arrow 51 in FIG. 3, the rods 49 can be appropriately elevationally adjustable, for example, by means of an eccentric drive or a correspondingly designed adjusting screw, so that the bias of the tension springs 31.1 can be adjusted. To that end any such suitable adjustment means or facility has been indicated by reference numeral 80 in FIG. 3.

Two abutments 36.1 define the predetermined abutment position of the grid bar 23.1, i.e. the position of the minimum depth of penetration or projection of the fiber flock extraction elements, like elements 22 of FIG. 2. As will be recognized from FIG. 3, two further optionally adjustable abutments 52 are provided for determining the position of maximum depth of penetration or projection.

As FIG. 4 shows, the double-armed levers 44 are arranged alongside one another at the stationary pivots or pivot shafts 45 such that no intermediate members or spacers are required. The grid bars 23.1, which in top plan view are substantially I-shaped, are likewise arranged directly alongside one another without intermediate members and are thus secured against displacement in the longitudinal direction of the extraction arm 11. The grid bars 23.1 are prevented from lateral tilting by means of the wide cylindrical heads 46, as well as from movement in the transverse direction or the extraction arm 11. The cylindrical heads 46 of the individual double-armed levers 44 are made somewhat narrower than the associated ends or the grid bars 23.1. In this manner, it is ensured that the cylindrical head 46 does not simultaneously engage in the recesses or openings 47 of two grid bars 23.1. It is readily conceivable that in the embodiment depicted in FIGS. 3 and 4 the grid bars 23.1 are individually adjustable.

Figure 5:
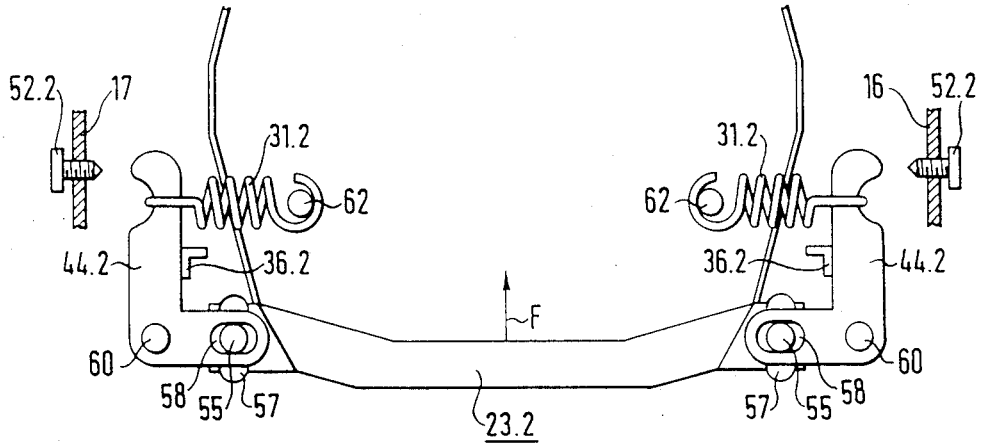
FIG. 5 is a side view, similar to that of FIG. 2, but of an exemplary embodiment of the adjustable grid constructed according to the present invention and in which a group of grid bars or an entire or complete grid or grid structure is adjustable as a whole or unit.
Figure 6:
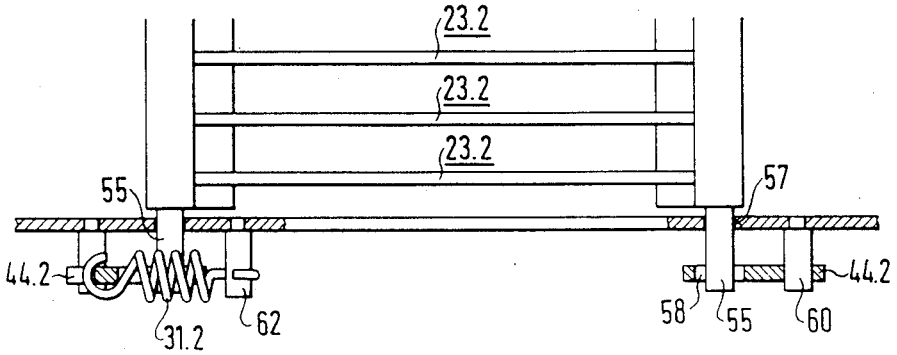
FIG. 6 is a top plan view of the grid bar depicted in FIG. 5 and shows three grid bars of the group of grid bars or of the entire or complete grid or grid structure.

FIGS. 5 and 6 show a further exemplary embodiment of the adjustable grid in which the grid bars are adjustable in groups, and this embodiment being equally applicable for adjusting an entire or complete grid or grid structure. The same or analogous components or parts are generally conveniently denoted by the same reference characters used for previous embodiments depicted in FIGS. 1 through 4, but they are distinguishable by the suffix 0.2.

The individual grid bars 23.2, which in this case are appropriately fastened to one another, are supported at both ends at guide rods 55 which are adjustable in the substantially perpendicular direction by respective angle levers 44.2. The guide rods 55 are arranged in substantially perpendicular slot guides 57 at the end faces or walls or the extraction arm 11 or at intermediate locations or walls thereof, so that when a force F is exerted upon the grid bars 23.2, the latter move in the substantially perpendicular direction, guided by the guide rods 55 which are likewise guided by the slot guides 57. Each angle lever 44.2 comprises a substantially horizontal slot guide 58 at its end facing the associated guide rod 55, so that the guide rods 55 are downwardly biased under the load of the tension springs 31.2. The substantially horizontal slot guides 58 ensure that the grid bars 23.2 are not laterally moved when the angle levers 44.2 rotate about respective pivots or pivot shafts 60. To prevent the grid bars 23.2 from jamming when in an inclined or slanting position, a certain clearance must be provided between the guide rods 55 and the substantially perpendicular or upright slot guides 57 or between the guide rods 55 and the grid bars 23.2.

Abutments 36.2 define the abutment position, i.e. the minimum depth of penetration or projection. Other adjustable abutments 52.2, structured in this case as adjusting screws which are screwed into the lateral lengthwise sides 16 and 17, render possible the alteration of the maximum depth of penetration or projection.

The ends of the tension springs 31.2, which ends are remote from the double-armed levers 44.2, are secured to stud bolts 62 arranged at the end faces or walls of the extraction arm 11 and thus beyond the region of the rotatable extraction roll or roller 19. If required, the stud bolts 62 can be constructed as eccentric drives, so that the bias of the tension springs 31.2 can be adjusted. As in all the other exemplary embodiments, the grid bars 23.2 can be spring-loaded at one end only, and the other end can be simply pivotably mounted if the extraction arm 11 moves or extracts fiber flocks or the like in one direction only.

Alternatively, tension springs 31.2 can be used at just one end of the grid bars 23.2, but still allowing or obtaining an adjustment of the opposite ends of the grid bars 23.2. This is shown in the exemplary embodiment depicted in FIGS. 7 and 8, in which once again the same or analogous components or parts are generally denoted by the same reference characters used for previous embodiments depicted in FIGS. 1 through 6, but they are distinguishable by the suffix 0.3.

Figure 7:
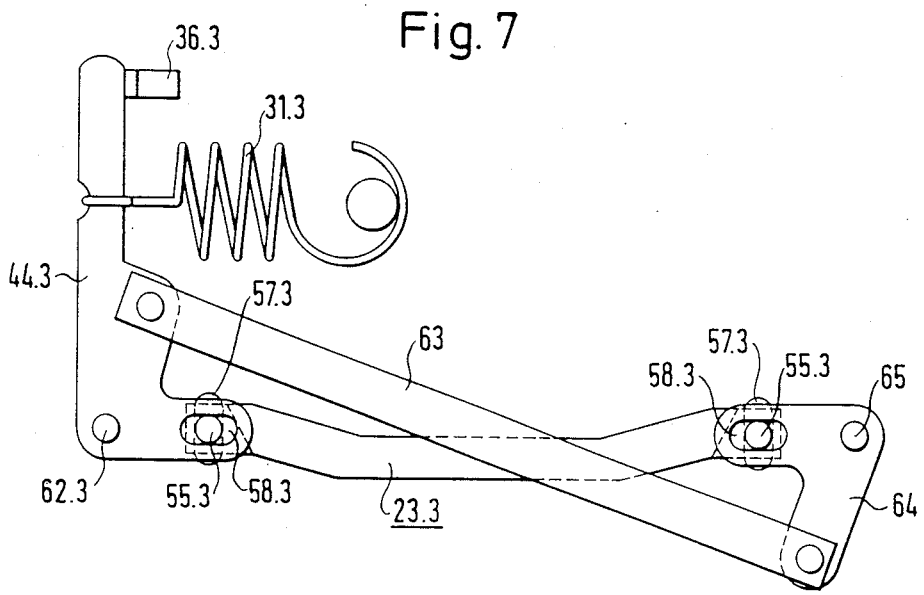
FIG. 7 is a side view of a further exemplary embodiment of the adjustable grid constructed according to the invention and similar to that of FIG. 5.

The basic arrangement at the left side of FIG. 7 is very similar to that in FIG. 5, except for the fact that the angle lever 44.3 is coupled by means of a linkage 63 to a further lever 64 which is likewise an angle lever. The end of this angle lever 64, which end is remote from the grid bar 23.3, is extended downwards to the location at which it is pivoted to the linkage 63. This means that when the left side of grid bar 23.3 is raised the angle lever 64 is rotated in the opposite direction and, by means of the linkage 63, results in rotation of the angle lever 64 in the clockwise direction, thus raising or lifting the right side of the grid bar 23.3. In other words, raising the right side of the entire or complete grid or grid bar 23.3 results in raising the left side of the entire or complete grid and in further biasing of the tension spring 31.3. Consequently, the entire grid or each grid bar 23.3 always moves substantially parallel to the position shown in FIG. 7. The guidance of the entire or complete grid is effected by means of guide bars 55.3 and slot guides 58.3 and 57.3 precisely as in the embodiment depicted in FIGS. 5 and 6. In the present embodiment the pivot or pivot shaft 65 of the angle lever 64 is structured as an axis of rotation and extends through the extraction arm 11 to a further lever 66 which is constructed exactly in the same manner as the angle lever 64, whereby the downwardly extending arm can be omitted if no second linkage is provided. Consequently, the entire left side of the entire or complete grid or grid structure is simultaneously raised or lowered. The pivot or pivot shaft 62.3 of the angle lever 44.3 is also structured as an axis of rotation, so that this angle lever 44.3 is coupled with the corresponding angle lever 44.3 located at the rear end of the extraction arm 11.

This embodiment requires only one abutment 36.3 which is arranged above the tension spring 31.3. Alternatively, the pivots or pivot shafts 62.3 and 65 can be stud bolts or pins, in which case an additional linkage would be provided between the further angle lever 66 and the associated angle lever 44.3 located at the rear end of the extraction arm 11.

Figure 8:
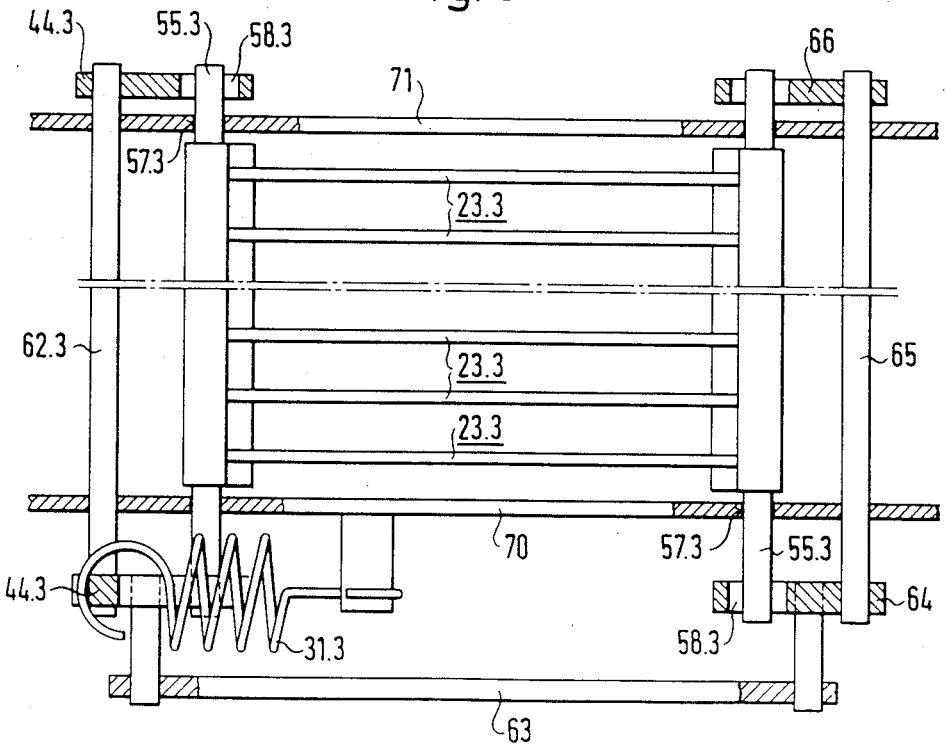
FIG. 8 is a top plan view of the exemplary embodiment illustrated in FIG. 7 and shows in this case an entire or complete grid or grid structure.

In FIG. 8, the walls designated by reference characters 70 and 71 can be the end walls of the extraction arm 11 or, alternatively, the end wall 71 can be just an intermediate wall of the extraction arm 11, so that a number of such grids are arranged in the longitudinal direction of the extraction arm 11.

While there are shown and described present preferred embodiments of the invention, it is to be distinctly understood that the invention is not limited thereto, but may be otherwise variously embodied and practiced within the scope of the following claims. Accordingly,

What we claim is:

1. An adjustable grid for an extraction arm of a bale-opener machine, comprising:

drivable fiber flock extraction elements;

an extraction arm having a predetermined lengthwise direction and cooperating with said drivable fiber flock extraction elements;

grid bars each having two opposite ends and being substantially transversely arranged with respect to said predetermined lengthwise direction;

said drivable fiber flock extraction elements extending through and between adjacent ones of said grid bars;

a plurality of spring devices having a predetermined spring force;

said plurality of spring devices placing said grid bars under a load which is at least predominantly perpendicularly directed to the surface of a bale to be opened by means of said drivable fiber flock extraction elements extending through and between adjacent ones of said grid bars;

each of said grid bars being movably mounted at the two opposite ends thereof on opposite sides of said drivable fiber flock extraction elements and biased by said spring devices into a predetermined abutment position;

said predetermined abutment position corresponding to a minimum depth of penetration of said drivable fiber flock extraction elements between said grid bars;

the bales to be opened each having a bale hardness; and said predetermined spring force of said spring devices being such that said moveably arranged grid bars are moved with increasing bale hardness in a direction of increasing depth of penetration of said drivable fiber flock extraction elements into a position in which the drivable fiber flock extraction elements have a depth of penetration which at least approximately corresponds to said hardness of said bale.

2. The adjustable grid as defined in claim 1, further including:

means for manually presetting said predetermined abutment position.

3. The adjustable grid as defined in claim 1, further including:

means for automatically presetting said predetermined abutment position.

4. The adjustable grid as defined in claim 1, further including:

abutment means defined a predetermined maximum depth of penetration of said drivable fiber flock extraction elements between said grid bars.

5. The adjustable grid as defined in claim 4, further including:

means for manually adjusting said abutment means.

6. The adjustable grid as defined in claim 4, further including:

7. The adjustable grid as defined in claim 1, wherein:

said grid bars placed under the load of said plurality of spring devices constitute self-adjustable grid bars which are self-adjustable with respect to increasing said depth of penetration in response to an increase in said bale hardness.

8. The adjustable grid as defined in claim 4, wherein:

said grid bars are adjustable in groups.

9. The adjustable grid as defined in claim 8, further including:

said extraction arm having lengthwise sides;

a guide rod mounted at each lengthwise side of said extraction arm in said predetermined lengthwise direction;

each group of grid bars having two lengthwise sides arranged substantially parallel to said extraction arm;

said guide rods extending through each group of grid bars;

said extraction arm having end faces substantially perpendicular to said predetermined lengthwise direction;

guide means provided at said end faces of said extraction arm;

said guide rods being guided at both ends thereof in said guide means;

each group of grid bars comprising at least two said spring devices at least at one of said two lengthwise sides; and at least said guide means of said extraction arm provided at said at least one of said two lengthwise sides being constructed for the associated guide rod as substantially perpendicularly extending elongated holes.

10. The adjustable grid as defined in claim 8, wherein:

said extraction arm has lengthwise sides;

a guide rod mounted at each lengthwise side of said extraction arm in said predetermined lengthwise direction;

each group of grid bars having two lengthwise sides arranged substantially parallel to said extraction arm;

said guide rods extending through each group of grid bars;

said extraction arm having end faces substantially perpendicular to said predetermined lengthwise direction;

guide means provided at said end faces of said extraction arm;

said guide rods being guided at both ends thereof in said guide means and at intermediate locations in said intermediate guide means of said extraction arm;

each group of grid bars comprising at least two said spring devices at least at one of said two lengthwise sides; and at least said guide means and said intermediate guide means of said extraction arm provided at said one of said two lengthwise sides being constructed for the associated guide rod as substantially perpendicularly extending elongated holes.

11. The adjustable grid as defined in claim 8, wherein:

said spring devices are provided at both of said two lengthwise sides of each group of grid bars; and said guide means and said intermediate guide means of said extraction arm being constructed as substantially perpendicularly extending elongated holes for said guide rods located at both lengthwise sides of said extraction arm.

12. The adjustable grid as defined in claim 11, wherein:

each spring device of said plurality of spring devices comprises a spring-loaded lever.

13. The adjustable grid as defined in claim 12, wherein:

each spring-loaded lever has an end encompassing the associated guide rod; and said spring-loaded lever end comprising a substantially horizontally extending slot guide for said associated guide rod.

14. The adjustable grid as defined in claim 13, wherein:

said spring-loaded levers are structured as double armed angle levers; and said double-armed angle levers each having one arm acting at the associated guide rod and a spring-loaded arm.

15. The adjustable grid as defined in claim 14, further including:

linkage means for connecting said double-armed angle levers located at the lengthwise sides of said extraction arm;

at least one of said at least two double-armed angle levers at one lengthwise side of said extraction arm being directly spring-loaded; and said at least two double-armed angle levers at the other lengthwise side of said extraction arm being coupled to said at least one directly spring-loaded double-armed angle lever by said linkage means for elevationally displacing in the same direction the associated lengthwise side of each group of grid bars.

16. The adjustable grid as defined in claim 12, wherein:

said abutment means comprise limit stops; and said predetermined abutment position being determined by said limit stops cooperating with said spring-loaded levers.

17. The adjustable grid as defined in claim 16, wherein:

the bias of said plurality of spring devices is individually adjustable for each spring device.

18. The adjustable grid as defined in claim 16, wherein:

the bias of said plurality of spring devices is commonly adjustable for all spring devices.

19. The adjustable grid as defined in claim 4, wherein:

said grid bars are rigidly interconnected;

said rigidly interconnected grid bars forming an entire grid for automatic adaptation of the depth of penetration; and said entire grid being pressably moveable as a unit out of said predetermined abutment position against said predetermined spring force of said plurality of spring devices.

20. The adjustable grid as defined in claim 17, wherein:

said extraction arm has lengthwise sides;

a guide rod mounted at each lengthwise side of said extraction arm in said predetermined lengthwise direction;

said entire grid having two lengthwise sides arranged substantially parallel to said extraction arm;

said guide rods extending through said entire grid;

said extraction arm having end faces substantially perpendicular to said predetermined lengthwise direction;

guide means provided at said end faces of said extraction arm;

said guide rods being guided at both ends thereof in said guide means;

said entire grid comprising at least two spring devices at least at one of said two lengthwise sides; and at least said guide means of said extraction arm provided at said at least one of said two lengthwise sides being constructed for the associated guide rod as substantially perpendicularly extending elongated holes.

21. The adjustable grid as defined in claim 19, wherein:

said extraction arm has lengthwise sides;

a guide rod mounted at each lengthwise side of said extraction arm in said predetermined lengthwise direction;

said entire grid having two lengthwise sides arranged substantially parallel to said extraction arm;

said guide rods extending through said entire grid;

said extraction arm having end faces substantially perpendicular to said predetermined lengthwise direction;

guide means provided at said end faces of said extraction arm;

intermediate guide means of said extraction arm;

said guide rods being guided at both ends thereof in said guide means and at intermediate locations in said intermediate guide means of said extraction arm;

said entire grid comprising at least two spring devices at least at one of said two lengthwise sides; and at least said guide means and said intermediate guide means of said extraction arm provided at said one of said two lengthwise sides being constructed for the associated guide rod as substantially perpendicularly extending elongated holes.

22. The adjustable grid as defined in claim 21, wherein:

said spring devices are provided at both of said two lengthwise sides of said entire grid; and said guide means and said intermediate guide means of said extraction arm being constructed as substantially perpendicularly extending elongated holes for said guide rods located at both lengthwise sides of said extraction arm.

23. The adjustable grid as defined in claim 22, wherein:

each spring device of said plurality of spring devices comprises a spring-loaded lever.

24. The adjustable grid as defined in claim 23, wherein:

each spring-loaded lever has an end encompassing the associated guide rod; and said spring-loaded lever end comprising a substantially horizontally extending slot guide for said associated guide rod.

25. The adjustable grid as defined in claim 24, wherein:

said spring-loaded levers are structured as double-armed angle levers; and said double-armed angle levers each having one arm acting at the associated guide rod and a spring-loaded arm.

26. The adjustable grid as defined in claim 25, further including:

linkage means for connecting said double-armed angle levers located at the lengthwise sides of said extraction arm;

at least one of said at least two double-armed angle levers at one lengthwise side of said extraction arm being directly spring-loaded; and said at least two double-armed angle levers at the other lengthwise side of said extraction arm being coupled to said at least one directly spring-loaded double-armed angle lever by said linkage means for elevationally displacing in the same direction the associated lengthwise side of said entire grid.

27. The adjustable grid as defined in claim 23, wherein:

said abutment means comprise limit stops; and said predetermined abutment position being determined by said limit stops cooperating with said spring-loaded levers.

28. The adjustable grid as defined in claim 27, wherein:

the bias of said plurality of spring devices is individually adjustable for each spring device.

29. The adjustable grid as defined in claim 27, wherein:

the bias of said plurality of spring devices is commonly adjustable for all spring devices.

means for automatically adjusting said abutment means.

30. An adjustable grid for an extraction arm of a bale-opener machine, comprising:

drivable fiber flock extraction elements;

an extraction arm having a predetermined lengthwise direction and cooperating with said drivable fiber flock extraction elements;

grid bars each having two opposite ends and being substantially transversely arranged with respect to said predetermined lengthwise direction;

said drivable fiber flock extraction elements extending through said grid bars;

a plurality of spring devices having a predetermined spring force;

each of said grid bars being movably arranged at the two opposite ends thereof and biased by said spring devices into a predetermined abutment position;

said predetermined abutment position corresponding to a minimum depth of penetration of said drivable fiber flock extraction elements between said grid bars;

the bales to be opened each having a bale hardness;

said predetermined spring force of said spring devices being such that said moveably arranged grid bars are moved, in accordance with said bale hardness, in a direction of increasing depth of penetration of said drivable fiber flock extraction elements into a position which at least approximately corresponds to an appropriate depth of penetration of the drivable fiber flock extraction elements;

abutment means defining a predetermined maximum depth or penetration of said drivable fiber flock extraction elements between said grid bars; and said grid bars being individually biased into said predetermined abutment position by means of respective spring devices of said plurality of spring devices.

31. The adjustable grid as defined in claim 30, further including:

at least one guide rod mounted at said extraction arm;

each grid bar having a longitudinal direction;

each grid bar comprising at least at one end thereof an elongated hole which extends at least substantially perpendicular to said longitudinal direction;

said guide rod extending through said elongated hole; and each spring device comprising a compression spring arranged between said one end of each grid bar and said extraction arm.

32. The adjustable grid as defined in claim 31, further including:

means for positionally adjusting said guide rod mounted at said extraction arm.

33. The adjustable grid as defined in claim 31, wherein:

one end of said elongated hole determines said predetermined abutment position upon contact thereof with said guide rod extending through said elongated hole.

34. The adjustable grid as defined in claim 33, wherein:

an opposite end of said elongated hole is open.

35. The adjustable grid as defined in claim 34, further including:

pins provided at least at said one end of said grid bars;

said compression spring being structured as a helical compression spring; and said helical compression spring being retained and centered by a respective pin at least at said one end of the associated grid bar.

36. The adjustable grid as defined in claim 35, further including:

flanges inwardly protruding at said extraction arm;

one end of each helical compression spring being supported by a respective flange at said extraction arm; and said one end of each helical compression spring being located remote from the associated grid bar.

37. The adjustable grid as defined in claim 36, further including:

studs mounted at respective flanges and extending in substantially perpendicular direction in relation to an associated grid bar; and each stud serving to retain and center an associated helical compression spring.

38. The adjustable grid as defined in claim 8, wherein:

said extraction arm is provided with openings; and said guide rod slidably extending through said openings in said extraction arm.

39. The adjustable grid as defined in claim 15, wherein:

said at least one guide rod comprises a plurality of guide rods;

said grid bars are provided at their two opposite ends with respective elongated holes; and said guide rods slidably extending through said elongated holes at said grid bar ends.

40. The adjustable grid as defined in claim 30, further including:

levers pivotably arranged at said extraction arm;

at least one end of each grid bar engaging one end of a respective lever serving to press the respective grid bar into said predetermined abutment position;

said spring devices comprising springs; and said springs acting each upon respective levers.

41. The adjustable grid as defined in claim 40, wherein:

said springs constitute tension springs which are tensioned between said extraction arm and said levers.

42. The adjustable grid as defined in claim 41, wherein:

said levers constitute double-armed levers;

said tension springs acting at ends of said double-armed levers and which ends are remote from said grid bars.

43. The adjustable grid as defined in claim 42, wherein:

said double-armed levers constitute angle levers.

44. The adjustable grid as defined in claim 42, further including:

limit stops defining said predetermined abutment position for said grid bars; and arms of said double-armed levers abutting against said limit stops.

45. The adjustable grid as defined in claim 44, wherein:

each double-armed lever comprises a cylindrical and portion;

each grid bar is provided at least at one end thereof with a lateral recess;

said cylindrical end portion of each double-armed lever engaging with and being displaceably guided in the associated lateral recess; and said cylindrical end portion of each double-armed lever serving to prevent lateral tilting of the associated grid bar.

46. The adjustable grid as defined in claim 45, wherein:

said extraction arm has oppositely located sides;

a common pivot shaft provided at each side of said extraction arm;

said double-armed levers being arranged at each side of said extraction arm at said common pivot shafts; and said double-armed levers having lateral contact with one another in the region of the associated common pivot shaft.

47. The adjustable grid as defined in claim 46, wherein:

each grid bar comprises in top plan view a substantially I-shaped profile; and adjacent grid bars contacting one another at the end faces of top and bottom legs of the associated I-shaped profile.

48. The adjustable grid as defined in claim 45, wherein:

said extraction arm has opposite sides;

a common pivot shaft provided at each side of said extraction arm;

groups of said double-armed levers being arranged at each side of said extraction arm at said common pivot shafts; and said double-armed levers of said groups of double-armed levers having lateral contact with one another in the region of the associated common pivot shaft.

* * * * *